US012030605B1

(12) United States Patent
Stampick

(10) Patent No.: US 12,030,605 B1
(45) Date of Patent: Jul. 9, 2024

(54) SHALLOW WATER PROPELLERS

(71) Applicant: Roost Marine LLC, Ogden, UT (US)

(72) Inventor: Aaron Stampick, Ogden, UT (US)

( * ) Notice: Subject to any disclaimer, the term of this patent is extended or adjusted under 35 U.S.C. 154(b) by 0 days.

(21) Appl. No.: 18/346,478

(22) Filed: Jul. 3, 2023

Related U.S. Application Data

(60) Provisional application No. 63/368,040, filed on Jul. 8, 2022.

(51) Int. Cl.

| | |
|---|---|
| ***B63H 1/26*** | (2006.01) |
| ***B63H 1/18*** | (2006.01) |
| ***B63H 1/20*** | (2006.01) |
| ***B63H 1/28*** | (2006.01) |
| ***B63H 3/00*** | (2006.01) |

(52) U.S. Cl.
CPC ..... *B63H 1/26* (2013.01); *B63H 1/20* (2013.01); *B63H 1/28* (2013.01); *B63H 3/002* (2013.01); *B63H 2001/185* (2013.01)

(58) Field of Classification Search
CPC ... B63H 1/26; B63H 1/20; B63H 1/28; B63H 3/002; B63H 2001/185
USPC ..... 416/223 R, 235, 242
See application file for complete search history.

(56) References Cited

U.S. PATENT DOCUMENTS

| | | | | |
|---|---|---|---|---|
| 4,789,306 A * | 12/1988 | Vorus | B63H 1/26 416/243 |
| 5,205,765 A * | 4/1993 | Holden | B63H 1/18 440/38 |
| 7,637,722 B1 * | 12/2009 | Koepsel | B63H 1/14 416/241 R |
| 2009/0314698 A1 * | 12/2009 | Higbee | B01F 27/113 210/150 |

* cited by examiner

*Primary Examiner* — Hoang M Nguyen
(74) *Attorney, Agent, or Firm* — Miller IP Law; Devin Miller

(57) ABSTRACT

A device includes a hub and a blade. The hub has a cylindrical geometry. The blade extends radially from the hub. The blade has a helical structure. The blade includes a leading edge, a winglet, a trailing edge, and a trough. The leading edge is formed on the blade and has an arcuate geometry. The winglet of the blade is distal relative to the hub. The winglet angles away from a surface of the blade. The trailing edge is formed on the blade to be opposite the leading edge. At least a portion of the trailing edge forms a pitch-line cup that is angled with respect to the surface of the blade. The trough is formed in a transition between the pitch-line cup of the trailing edge and the winglet. The trough forms a recess that is relatively closer to the surface of the blade.

20 Claims, 5 Drawing Sheets

SHALLOW WATER PROPELLERS

CROSS-REFERENCE TO RELATED APPLICATION

This application claims the benefit of U.S. Provisional Application No. 63/368,040, filed Jul. 8, 2022.

BACKGROUND

Vehicles for traversing a water environment may use a variety of manners of propulsion that allow the vehicle to move through or over the water. For example, a marine boat motor propeller may be fully submersed in the water to provide thrust or an airboat motor propeller may engage with the air to provide thrust. Different vehicles may have different capabilities and restrictions. Mud propellers are propellers designed to function submersed in hazardous and shallow waters that would otherwise be unnavigable.

BRIEF DESCRIPTION OF THE DRAWINGS

The present description will be understood more fully when viewed in conjunction with the accompanying drawings of various examples of shallow water propellers. The description is not meant to limit the shallow water propellers to the specific examples. Rather, the specific examples depicted and described are provided for explanation and understanding of shallow water propellers. Throughout the description, the drawings may be referred to as drawings, figures, and/or FIGs.

DETAILED DESCRIPTION

Figure 1:
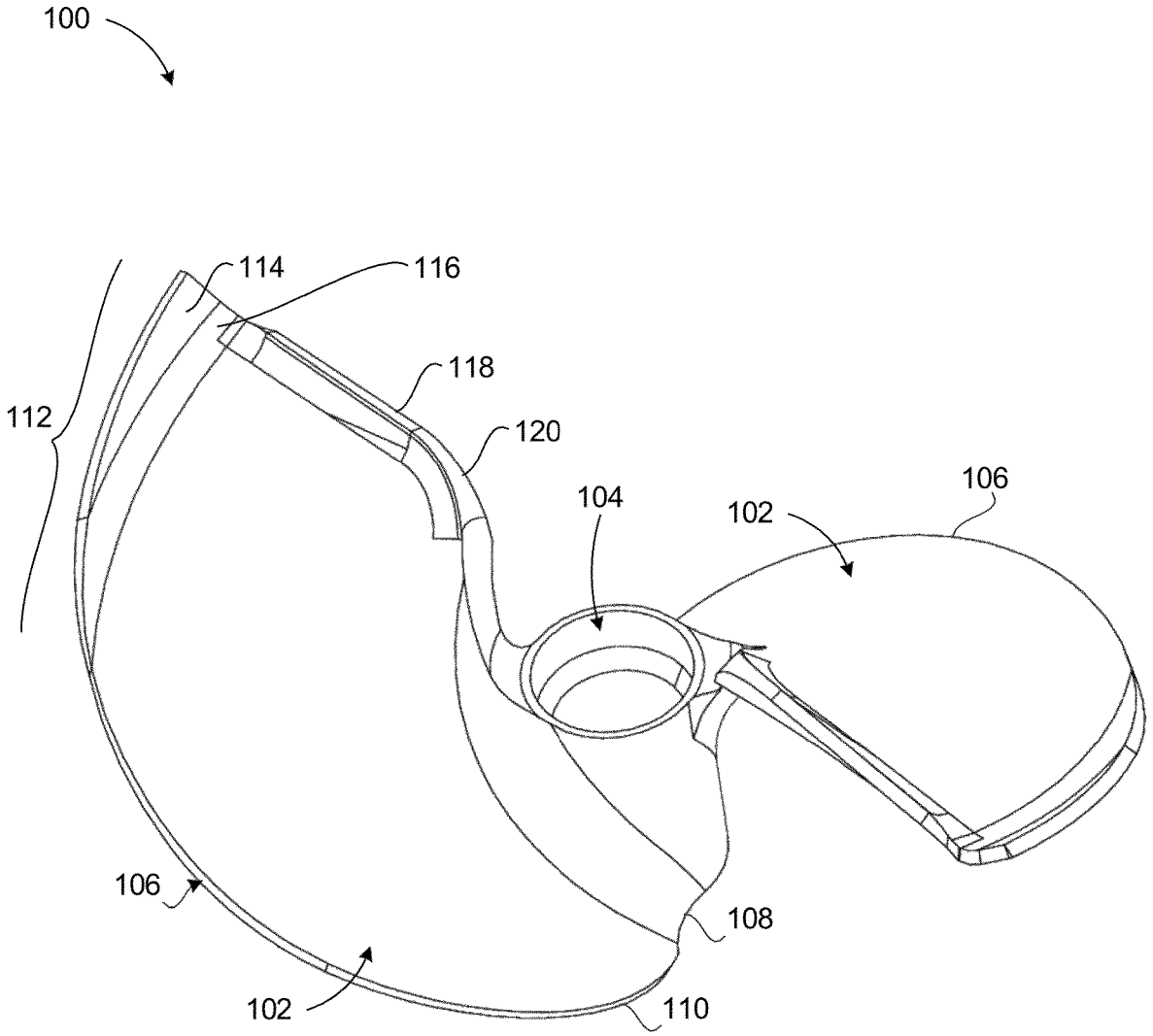
FIG. 1 illustrates a perspective view of a shallow water propeller, according to an embodiment.

Shallow water propellers as disclosed herein will become better understood through a review of the following detailed description in conjunction with the figures. The detailed description and figures provide merely examples of the various embodiments of shallow water propellers. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

Conventional propellers intended for maritime use may experience difficulties in shallow water. In motorized maritime transportation a specific category of boat motors exists, generically termed "mud motors." Mud motors are purpose-built boat motors designed to operate in hazardous, shallow, and otherwise unnavigable waters which would typically destroy recreational boat motors and/or strand boats using recreational motors. Mud motors use a heavy-duty propeller, commonly called a "mud propeller" or "mud prop," which is also purpose-built to operate in these conditions without sustaining damage or excessive wear and tear. Historically, these propellers are built to operate in heavy vegetation, mud, around submerged logs and tree stumps, and other underwater hazards. Conventional mud propellers are most notable for their ability to propel a boat by using mud in addition to, or in place of water. This attribute has given mud motors a reputation of "four-wheel-drive-like" performance in a boat motor. Conventional mud propellers have multiple shortcomings which are interrelated but can be broken into four main shortcomings.

The first shortcoming of mud propellers is that they are designed to operate a boat with the propeller digging through soft mud. In particular, the consistency of the mud must be quite soft and of a fluid consistency (essentially pourable). In thick muds that cannot be poured in a steady flow, the performance of conventional mud propellers degrades. When mud thickens to the extent of being gloppy, clumpy, or clay-like, the performance of conventional mud propellers declines sharply because the mud is no longer able to flow like fluid when engaged by the mud propeller. When mud becomes hard-packed or sandy from high levels of non-organic sediment, conventional propellers become effectively useless. This type of mud is typically so hard that the propeller is unable to penetrate and slice through the mud in order to use it for propulsion, leaving the user stuck or stranded.

Second, if the mud happens to be just soft enough for the propeller blades to penetrate and slice through, then the propeller suffers severe wear from the extreme abrasion characteristics of this type of mud/sand. This abrasion changes blade geometry that is critical to the performance of the propeller. Because conventional mud propellers are extremely dependent on rake-line and pitch-line cupping for proper performance, loss of this critical geometry can be catastrophic. Conventional mud propeller design places the most important areas of rake-line and pitch-line cup in the areas of the propeller blade which suffer the greatest wear from abrasive mud compositions. Once this cupping geometry is worn off, the propeller suffers a severe reduction in performance rendering the propeller much less effective in pure water or any kind of mud or mud/water combination. This is typically experienced as a loss of the propeller's ability to grip the water, which results in the propeller "blowing out" and engine over-revving. This severely impacts the ability of the motor to move the boat through mud, get on plane, attain full speed, move heavy boat loads, or retain fuel/energy efficiency.

The third shortcoming of conventional mud propellers is their loss of large amounts of thrust when subjected to aeration. Relevant examples of aeration are when air is mixed with the water/mud as it flows towards the propeller, from the propeller breaking the surface of the water as it spins, and/or vortices forming in the water as a result of propeller rotation. This low tolerance of conventional propellers to aeration has led some mud motor manufacturers to place devices on their motors, commonly referred to as "cavitation plates", which are intended to reduce or prevent air from being introduced into the water or mud. Some manufacturers have had success with this approach. However, this requires the cavitation plate to be completely under water for it to be effective, which means the water/mud must be deep enough to allow for full submersion of the cavitation plate. Any air, underneath the cavitation plate, nullifies the effectiveness of the cavitation plate. Regardless of whether the manufacturer employs some variant of a cavitation plate or not, when the water and/or mud depth is insufficient to accommodate sufficient submersion, conventional mud propellers can be rendered nearly useless and leave users stranded from propeller aeration. Cavitation and aeration can also lead to over-revving of the motor which can lead to mechanical wear or failure of the motor.

Because of the above-identified susceptibilities of conventional mud propellers, to be effective in pure water, the available mud-free water depth must typically be an approximate minimum of 1.5 times the diameter of the propeller in order to keep the tips of the propeller far enough below the surface of the water to avoid cavitation/aeration. This places a significant restriction on the minimum water depth in which these motors can be operated.

The fourth shortcoming of conventional mud propellers comes about because it requires more horsepower to spin a propeller through mud than is required to do so through water. For this reason, conventional mud propellers are designed to allow a high amount of propeller slip so the engine can attain sufficiently high rotational speed in mud. In pure water, this results in excessive amounts of propeller slip. A common failure of conventional mud propellers is their inability to push a heavier boat completely on plane in pure water, due to the amount of slip designed into the propeller. Typical symptoms of this failure are the engine revving to max or nearly max RPM with the propeller trimmed deep, the boat stuck in a wallow condition (bow high/transom low), and the propeller being unable to accelerate the boat and push it all the way on plane. The culmination of these above-identified shortcomings is a propeller that struggles to perform in deep water with larger boat loads, wears out quickly in abrasive mud, and is unable to provide acceptable or useable levels of thrust on shallow bodies of water where soft deep mud is unavailable and hard/abrasive mud is present. These conditions can render mud motors almost completely useless. For those individuals who manage to get a usable level of performance from conventional mud propellers in shallow water with hard/abrasive mud, severe wear and constant propeller replacement is required at inappropriately frequent intervals. Propellers are commonly destroyed in a single outing and in need of replacement before the next trip. Some users experience such severe wear that after arriving at their destination, they are unable to return because the propeller is so severely worn that it no longer produces sufficient thrust to push the boat on plane.

Implementations of shallow water propellers, as described herein, may address some or all of the problems described above. For example, an embodiment described herein may provide a weedless high-aeration shallow water propeller providing high-performance surface-piercing attributes. Embodiments of the shallow water propellers provide significantly enhanced performance in excessively shallow water where preventing the propeller from aerating is not possible due to insufficient water depth and lack of soft mud.

Embodiments of the high-aeration shallow water propeller may include new structural features which have been combined with certain prior art to allow it to produce useful thrust in highly aerated water without the need to dig into mud or sand. Embodiments of the propeller may also exhibit benefits of improved hole-shot (time to get the boat on-plane), better load pushing, improved top speed stability, and reduced engine overrevving during acceleration and at cruising speed. Embodiments of the shallow water propellers also have improved efficiency at reduced throttle settings due to a more linear RPM to thrust relationship. This enables higher than-typical speeds using reduced throttle settings. For at least this reason, embodiments of described herein allow users to keep up with others while using less fuel and extending useful operating range.

In some embodiments, the design elements providing these benefits may include an outer edge "winglet" on each blade, a pitch-line trough, a radiused trailing edge, and other aspects described herein.

FIG. 1 illustrates a perspective view of a shallow water propeller 100, according to an embodiment. Embodiments may provide for propulsion with partial submersion of the shallow water propeller 100.

In some embodiments, the shallow water propeller 100 provides thrust in a high-aeration environment. The shallow water propeller 100 may include a blade 102 extending from a central hub 104. In some embodiments, the blade 102 and hub 104 are monolithic. In other embodiments, the blade 102 may be a separate component that is couplable to the hub 104. In some embodiments, the blade 102 is non-removable. In other embodiments, the blade 102 may be removable from the hub 104 to facilitate replacement or selection based on anticipated conditions and/or use for the propeller 100.

In some embodiments, the blade 102 of the propeller 100 has a surface-area-to-radius ratio that is relatively high. This allows for greater engagement and improved performance in a shallow water situation. In some embodiments, the blade 102 includes a leading edge 106 formed at a periphery of the blade 102 that first engages to cut through the water and/or mud. The leading edge 106 may have a primarily arcuate or otherwise curved geometry. In some embodiments, the leading edge 106 has a complex curved geometry with two or more different radii of curvature or a varied radius of curvature.

In some embodiments, the leading edge 106 may include a first radial section 108 and a second radial section 110. The first radial section 108 may include a portion of the leading edge 106 proximate to the hub 104. The first radial section 108 may be generally concave in geometry. In some embodiments, the first radial section 108 may form a transition region between the hub 104 and the blade 102. The first radial section 108 may progress from approximately tangential to a surface of the hub 104 to approximately tangential to the second radial section 110 of the leading edge 106 which extends along the leading edge 106. The second radial section 110 has a primarily convex geometry and forms a majority of the leading edge 106 of the blade 102.

In some embodiments, the blade 102 includes a third radial section 112. The third radial section 112 may be positioned on an outer edge of the blade 102 and may form or correspond to a winglet 114 formed in the blade 102. A geometry of the third radial section 112 may vary relative to a geometry of the second radial section 110. In some embodiments, the winglet 114 is a raised portion of the blade 102 that curves axially to have a rake angle greater than that of the adjacent region of the blade 102. In some embodiments, the winglet 114 may have a rake angle that is greater than the rest of the blade 102. In some embodiments, the difference in rake angle is less than or greater than fifteen degrees. The winglet 114 may be adjusted in size, rake angle, helical axis, radial distance, and the like for a particular application or performance range. In some embodiments, the winglet 114 reduces water slipping or throwing from the blade 102 to improve thrust generation.

In some embodiments, the slip resistance and/or other performance of the winglet 114 may allow the propeller 100 to be operated in water covering approximately 50% of the radius of the propeller 100 while maintaining a corresponding boat or craft on-plane without mud interaction.

In some embodiments, the winglet 114 is formed in the blade 102 to have a transition radius 116. The transition radius 116 may form a trough between the winglet 114 and a trailing edge 118 of the blade 102. Tuning of a depth and width of the transition radius 116 may allow for tuning of the propeller 100 to accommodate or correspond to at least one of a top-end/low-end engine rotation, engine power or efficiency, propeller submersion level, boat size, boat weight, on-plane time, or the like.

In some embodiments, the trailing edge 118 curls up from the blade 102 to form a cup in conjunction with the winglet 114. The trailing edge 118 may provide increased grip and thrust. The trailing edge 118 may form the transition radius 116 with the winglet 114 to provide the characteristics described above. The trailing edge 118 may include a corner radius 120 formed as the trailing edge 118 transitions to the hub 104. The corner radius 120 may be adjusted to affect the performance of the propeller 100 during turns, maintain a craft on-plane, and further affect other performance aspects of the propeller 100.

In some embodiments, the trailing edge 118 is the last edge of the blade 102 which acts on the water during operation and may be characterized by its profile and pitch-line cup defined by the change in the angle of a face of the blade 102 at the trailing edge 118. The profile of the trailing edge 118 is the path which the trailing edge 118 follows as it progresses radially outward from the hub 104. This profile may be defined by a radial line (206 of FIG. 2) extending from the hub 104, an arc which originates at the hub 104, a line which is non-parallel to the radial line (206), an arc that does not intersect the hub 104, or any combination thereof. The trailing edge 118 may play a key role in tuning the performance of the propeller 100. For example, a trailing edge 118 defined by a straight radial line (206) provides a strong direct feel while an arch which intersects the hub 104 provides a softer feel. Trailing edges 118 which are non-radial form a type of rake, defined herein as a "second-axis rake", which acts similarly to traditional rake to either hold water on the blade or sling water off the blade. Second-axis rake is measured relative to a radial line (206) extending from the hub 104. Trailing edge 118 profiles which angle or arc toward the leading edge 106 create positive second-axis rake and trailing edge 118 profiles which angle or arc away from the leading edge 106 create negative second-axis rake.

In some embodiments, the trailing edge 118 does not terminate at the hub 104 in a conventional manner. The trailing end of the hub 104 may not extend all the way to the trailing edge 118 of the blade 102. In some embodiments, this forms an inside edge on the blade 102 which connects the trailing edge 118 to the trailing end of the hub 104. The inside edge extends most of its length along the helical path of the blade 102 with a slight radial translation along its length toward the trailing edge 118.

In some embodiments, the intersection of the inside edge and trailing edge 118 forms a sharp corner. This corner may be radiused according to the performance requirements of the propeller 100. The radius may be tangent with both the trailing edge 118 and inside edge. This radius 120 adjusts the amount of grip the propeller 100 exhibits. The smaller the radius 120, the more pronounced the corner, and greater grip is generated; restricting engine RPMs. The larger the radius 120, the less pronounced the corner, and less grip is generated; allowing the engine to rev more freely. This corner also creates additional surface area on the inner radius, not found in conventional mud propellers.

In some embodiments, each blade 102 exhibits a long swept leading edge 106 to deflect foreign objects/matter. The long leading edge 106 establishes a large surface area on the blade 102. In some embodiments, the leading edge 106 may have a surface which may not be perpendicular to the adjacent surfaces of a face of the blade 102. In some embodiments, the leading edge 106 may be angled slightly toward the load face or face of the blade 102 to control blade spray and introduce water to the blade face. In some embodiments, an excluded angle of the leading edge 106 may be less than 270 degrees. This angle relative to the load face may continue to the winglet 114 and may be maintained relative to the loaded face of the winglet 114. The leading edge 106 may terminate where it intersects the trailing edge of the blade 102 at the tip of the winglet 114. In some embodiments, the winglet 114 is formed by the same helical path, at the same pitch, and about the same helical axis as the rest of the blade 102.

Figure 2:
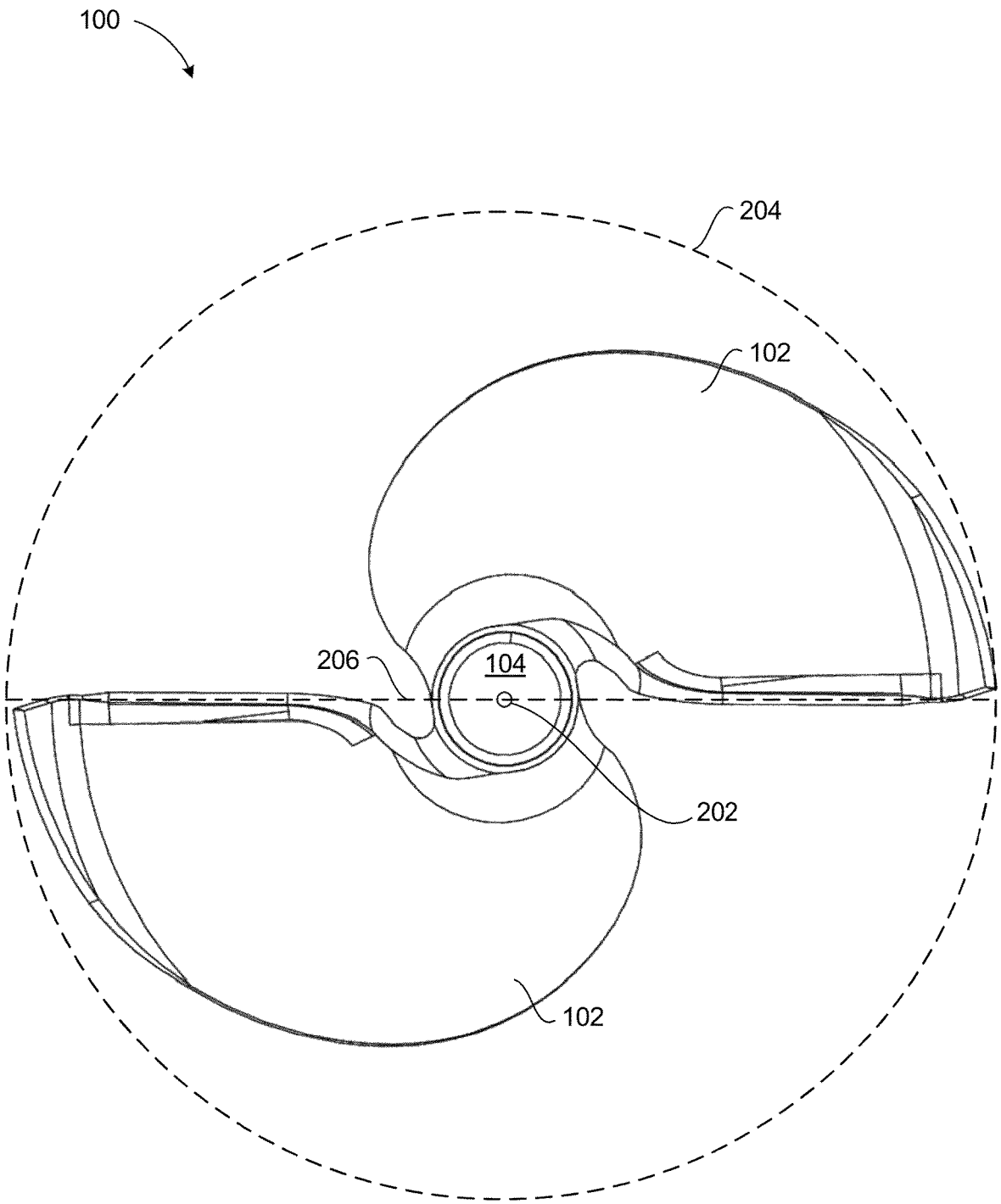
FIG. 2 illustrates a top view of the shallow water propeller of FIG. 1, according to an embodiment.

FIG. 2 illustrates a top view of the propeller 100 of FIG. 1, according to an embodiment. Embodiments provide a tunable design for shallow-water performance.

In some embodiments, the propeller 100 is centralized about the hub 104. The propeller 100 may have a central axis 202 concentric and coaxial with the hub 104. The hub 104 and helical path of rotation of the blades 102 may be coaxial. Each blade 102 may extend radially from the hub 104. A size, shape, and geometry of the hub 104 may be selected so as to attain proper form, fit, and function to correspond with a load, boat, and/or motor.

In some embodiments, the blades 102 are distributed evenly around the hub 104. A pitch and/or rake of the blade 102 may be adjusted to a desired application of the propeller 100. The rotation 204 of the propeller 100 may lie on a plane perpendicular to the central axis 202, where a center point of a circle corresponding to the rotation 204 is coincident with the central axis 202, and tips of the blade 102 may simultaneously touch the circumference of the circle defining the rotation 204.

Figure 3:
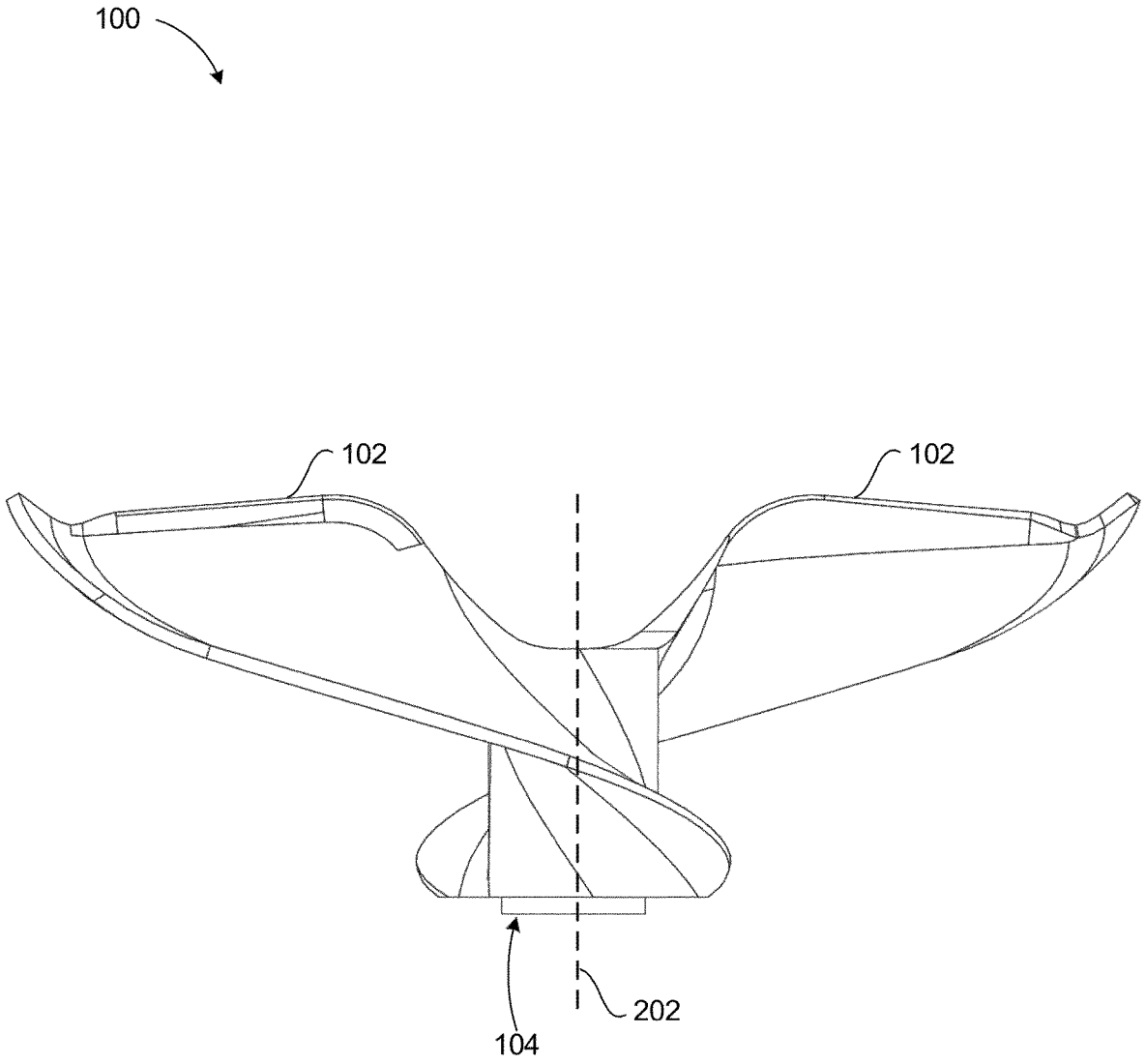
FIG. 3 illustrates a side view of the shallow water propeller of FIG. 1, according to an embodiment.

FIG. 3 illustrates a side view of the shallow water propeller 100 of FIG. 1, according to an embodiment. Embodiments provide a resilient and capable structure for navigating varied and/or mixed propulsion environments.

In some embodiments, the propeller 100 includes two blades 102 centered around the hub 104 and central axis 202. In other embodiments, the propeller 100 may include more than two blades 102. In some embodiments, the blades 102 may form an overlapping helical pattern around the hub 104.

Figure 4:
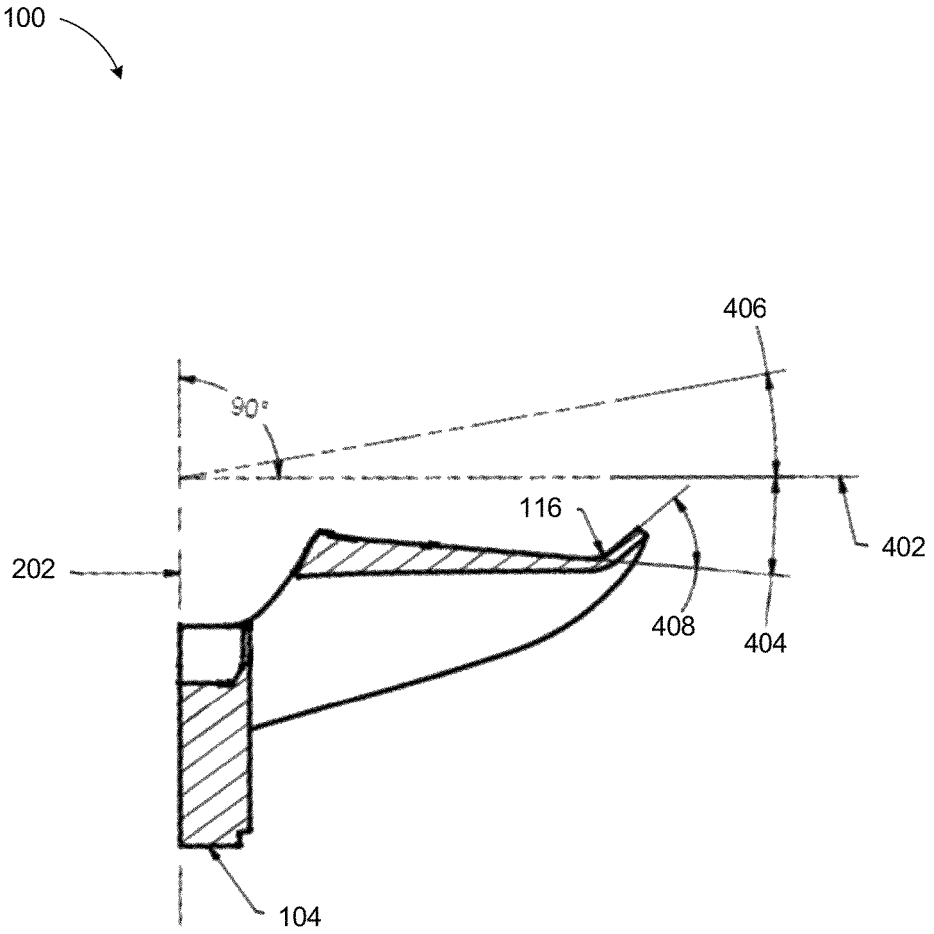
FIG. 4 illustrates a radially-facing cross-sectional view of a blade of the shallow water propeller of FIG. 1, according to an embodiment.

FIG. 4 illustrates a radially-facing cross-sectional view of the blade 102 of the shallow water propeller 100 of FIG. 1, according to an embodiment. Embodiments of the propeller 100 provide a thrust option that does not require complete submersion for effective operation.

In some embodiments, the propeller 100 may have a rake component. The rake may be measured relative to the central axis 202, where a perpendicular line 402 is considered 0 degrees of rake. Angles which deviate from 0 degrees toward the boat/motor are negative rake 404 and angles which deviate from 0 degrees away from the boat/motor are positive rake 406.

In some embodiments, the winglet 114 has 15 degrees or more of positive winglet rake 408 relative to the blade rake 404. The transition radius 116 from the blade rake angle 404 to the winglet rake angle 408 takes place over a short radial distance so as to generate a distinct winglet form.

Figure 5:
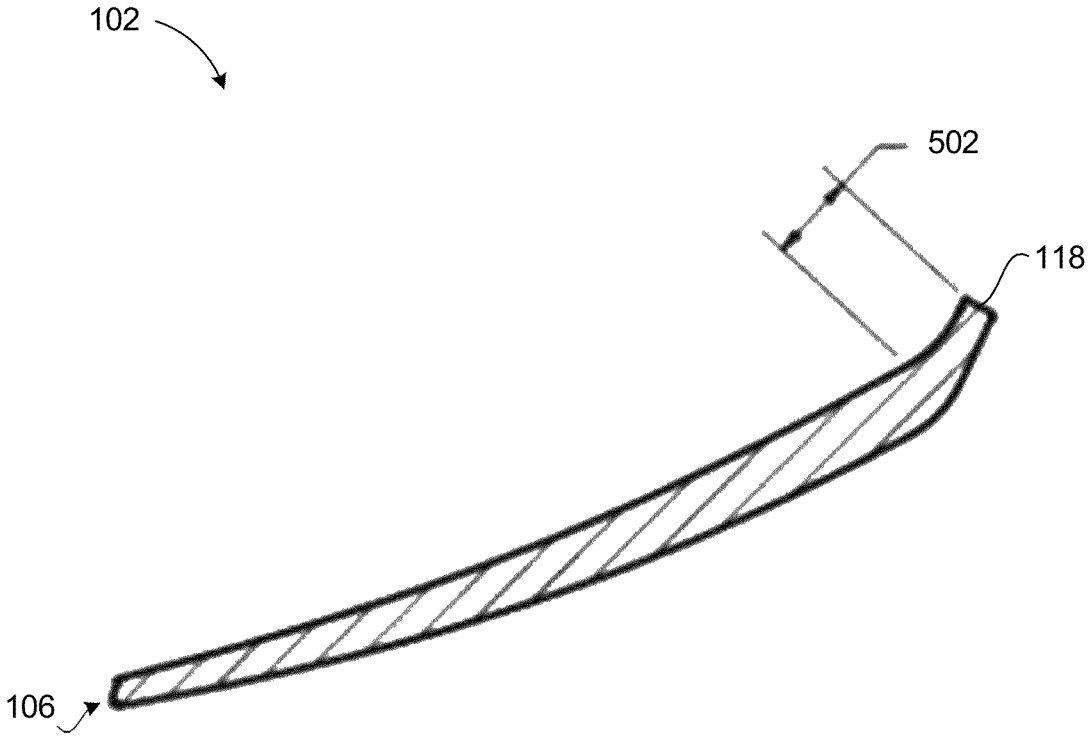
FIG. 5 illustrates an outward-facing cross-sectional view of the blade of the shallow water propeller of FIG. 1, according to an embodiment.

FIG. 5 illustrates an outward-facing cross-sectional view of the blade 102 of the shallow water propeller 100 of FIG.

1, according to an embodiment. Embodiments may provide tunable grip for operation in shallow water environments.

The pitch-line cup 502 is a region of concentrated progressive pitch located along the trailing edge 118 of the blade 102. The specific shape and size of the pitch-line cup 502 may be tuned to the environment, engine, boat, or another aspect of the operation of the propeller 100. The pitch-line cup 502 may be formed either as a continuation of the same helical path as the blade 102 or may be formed as an independent area of progressive pitch which may or may not lie on a helical path of the blade 102. In some embodiments, the base of the pitch-line cup 502 may begin tangent to blade 102 and then increase in pitch smoothly and/or rapidly. The pitch progression or cross-sectional radius of the pitch-line cup 502 may or may not vary along the length of the trailing edge 118.

The pitch-line cup 502 may terminate at the base in a smooth transition to blade 102 pitch, as it follows the inside corner radius until the inside corner radius is tangent with the inside edge. In some embodiments, the raised edge of the pitch-line cup 502 may not follow the trailing edge 118 all the way to the blade tip. In some embodiments, the pitch-line cup 502 may terminate as it transitions into the winglet 114. The pitch-line to winglet transition may occur at or near the winglet transition radius 116. This transition may form a trough of varying magnitudes between the full height of the pitch line cup 502 and the winglet 114. The resulting trough dips down toward the blade 102 surface and/or winglet transition radius 116, before climbing back out as the winglet 114.

The depth and width of this transitional trough may be adjusted to each propeller application. As such, this trough may not be readily visible in some or all variations of the propeller 100. The way in which the pitch-line cup 502 transitions into the winglet 114 may affect the performance attributes of the propeller 100. In some embodiments, termination of the pitch-line cup 502 may result in a shallower trough, narrower trough, or no trough at all. This may cause the pitch-line cup 502 to terminate higher on the winglet 114. Embodiments of the propeller 100 may utilize a monolithic construction which can be accomplished by various manufacturing methods, including but not limited to: casting, machining, and other reductive or additive manners of manufacturing.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C. and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A device, comprising:

a hub having a generally cylindrical geometry; and a first blade and a second blade coupled to the hub, wherein each blade is configured to extend radially outward from the hub, each blade having a helical structure relative to the hub, each blade comprising:

a surface area that lies between a leading edge formed at a periphery of the blade and a trailing edge formed on the blade opposite the leading edge, the surface area having a rake angle relative to the hub;

the leading edge having an arcuate geometry;

at least a portion of the trailing edge having a pitch-line cup which has a geometry that is angled with respect to the surface of the blade;

a winglet formed on the blade distal to the hub at an outer edge of the blade, the winglet is a raised portion of the blade that curves axially from the surface of the blade to have a rake angle greater than the rake angle of the surface of the blade adjacent to the winglet;

wherein the leading edge terminates at an intersection with the trailing edge of the blade at a tip of the winglet;

a trough formed in a transition between the pitch-line cup of the trailing edge and the winglet, the trough forming a recess between the pitch-line cup and the winglet; and an inside edge that connects the trailing edge of the blade to a trailing end of the hub, wherein a radiused corner is formed at an intersection of the inside edge and the trailing edge.

2. The device of claim 1, wherein the winglet has 15 degrees or more of positive winglet rake angle relative to the blade surface rake angle, wherein the positive winglet rake angle is adjustable for a particular application of the device.

3. The device of claim 1, wherein the winglet may be adjusted in size, rake angle, helical axis, and/or radial distance for a particular application of the device.

4. The device of claim 1, wherein the winglet is formed by a same helical path, at a same pitch, and about a same helical axis as a helical path, pitch, and helical axis of the blade.

5. The device of claim 1, wherein the trough formed in a transition between the pitch-line cup of the trailing edge and the winglet has a depth and width that can vary in magnitude and be adjusted for a particular application of the device.

6. The device of claim 5, wherein the transition between the pitch-line cup of the trailing edge and the winglet can be configured to form a shallow trough or a narrow trough to increase an amount of grip the device exhibits on water.

7. The device of claim 1, wherein a size of the radiused corner formed at the intersection of the inside edge and the trailing edge can be adjusted for a particular application of the device to adjust an amount of grip the device exhibits on water, from a smaller radius having a more pronounced corner and greater grip to a larger radius having a less pronounced corner and lesser grip.

8. A device, comprising:

a hub having a generally cylindrical geometry; and a first blade and a second blade coupled to the hub, wherein each blade is configured to extend radially outward from the hub, each blade having a helical structure relative to the hub, each blade comprising:

a surface area that lies between a leading edge formed at a periphery of the blade and a trailing edge formed on the blade opposite the leading edge;

the leading edge having an arcuate geometry;

a winglet formed on the blade distal to the hub at an outer edge of the blade, the winglet is a raised portion of the blade that curves axially from the surface of the blade;

a trough formed in a transition between the trailing edge and the winglet, the trough forming a recess between the trailing edge and the winglet; and an inside edge that connects the trailing edge of the blade to a trailing end of the hub, wherein a radiused corner is formed at an intersection of the inside edge and the trailing edge, and wherein the trailing edge comprises an adjustable corner radius formed as the trailing edge transitions to the hub.

9. The device of claim 8, wherein the leading edge has a complex curved geometry with two or more different radii of curvature or a varied radius of curvature.

10. The device of claim 8, wherein the leading edge comprises a first radial section and a second radial section, wherein the first radial section includes a portion of the leading edge proximate to the hub that forms a transition region between the hub and the second radial section, the first radial section having a concave geometry; and wherein the second radial section forms a majority of the leading edge and has a convex geometry.

11. The device of claim 8, wherein the leading edge has a swept configuration in which the leading edge is angled toward a load face of the blade with an excluded angle of less than 270 degrees.

12. The device of claim 11, wherein the excluded angle of the leading edge is continued to the winglet and maintained relative to a load face of the winglet.

13. A device, comprising:

a hub having a generally cylindrical geometry; and a first blade and a second blade coupled to the hub, wherein each blade is configured to extend radially outward from the hub, each blade having a helical structure relative to the hub, each blade comprising:

a leading edge formed at a periphery of the blade and a trailing edge formed on the blade opposite the leading edge;

the leading edge having an arcuate geometry;

a winglet formed on the blade distal to the hub at an outer edge of the blade, the winglet is a raised portion of the blade that curves axially from the blade;

a trough formed in a transition between the trailing edge and the winglet, the trough forming a recess between the trailing edge and the winglet; and an inside edge that connects the trailing edge of the blade to a trailing end of the hub, wherein a radiused corner is formed at an intersection of the inside edge and the trailing edge, and wherein the trailing edge comprises an adjustable corner radius formed as the trailing edge transitions to the hub.

14. The device of claim 13, wherein the trailing edge has a profile defined by a radial line extending from the central axis, an arc that originates at the hub, a line which is non-parallel to the radial line extending from the hub, an arc that does not intersect the hub, or any combination thereof.

15. The device of claim 13, wherein the trailing edge has a profile with a non-radial, second-axis rake relative to a radial line extending from the central axis that can be adjusted for a particular application of the device, in which a trailing edge profile that angles toward the leading edge creates positive second-axis rake and a trailing edge profile that angles away from the leading edge creates negative second-axis rake.

16. The device of claim 13, wherein the trailing edge has a profile comprising a path the trailing edge follows as it progresses radially outward from the hub, wherein the profile may be defined by a radial line extending from the central axis, an arc which originates at the hub, a line which is non-parallel to the radial line, an arc that does not intersect the central axis, or any combination thereof.

17. The device of claim 13, wherein the trailing edge curls up from the blade to form a pitch-line cup defined by a change in an angle of a face of the blade at the trailing edge.

18. The device of claim 17, wherein the pitch-line cup may be formed as a continuation of a same helical path as a helical path of the blade.

19. The device of claim 17, wherein the pitch-line cup is formed as an independent area of progressive pitch that does or does not lie on a helical path of the blade.

20. The device of claim 17, wherein the pitch-line cup has a pitch progression that does or does not vary along a length of the trailing edge.

* * * * *